United States Patent [19]

Kaulfuss et al.

[11] 4,043,086

[45] Aug. 23, 1977

[54] STRUCTURE FOR EXHIBITION PURPOSES

[75] Inventors: William P. Kaulfuss, Wilmette; Robert H. Kaulfuss, Northbrook, both of Ill.

[73] Assignee: Container Corporation of America, Chicago, Ill.

[21] Appl. No.: 679,003

[22] Filed: Apr. 21, 1976

[51] Int. Cl.[2] ..... E04B 1/346

[52] U.S. Cl. ..... 52/71; 52/36; 52/580; 52/461; 52/127

[58] Field of Search ..... 52/71, 461, 36, 470, 52/578, 35, 39, 631, 619, 622, 127, 726, 584, 580, 238, 586; 160/231

[56] References Cited

U.S. PATENT DOCUMENTS

| | | | |
|---|---|---|---|
| 3,224,489 | 12/1965 | Haberthier | 52/71 |
| 3,460,860 | 8/1969 | Stevens, Jr. | 52/71 |
| 3,609,773 | 10/1971 | Mustee | 52/71 |
| 3,733,758 | 5/1973 | Maier et al. | 52/71 |

*Primary Examiner*—Ernest R. Purser
*Assistant Examiner*—Robert C. Farber
*Attorney, Agent, or Firm*—Carpenter & Ostis

[57] ABSTRACT

There is disclosed a module for erected wall elements for providing an exhibition space, the wall elements being formed from fibrous material such as corrugated board folded along score lines to provide spaced front, rear and end wall portions, the wall elements being confined along the upper and lower edges by devices having spaced flanges confining the wall portions but having discontinuous portions to accommodate irregularities in the dimensioning of the wall elements and to enable the wall elements to be secured together at such discontinuous portions.

3 Claims, 7 Drawing Figures

STRUCTURE FOR EXHIBITION PURPOSES

BACKGROUND OF THE INVENTION

The structure according to the present invention lends itself primarily to use in connection with modular exhibit space for conventions. The structure is composed of light-weight modular elements which can be arranged in a number of ways in accordance with the needs of an exhibitor who is charged by the convention management in proportion to the amount of exhibit space occupied.

The structure according to the present invention adapts itself to many configurations and may be U-shaped, serpentine, semi-circular or random in form when viewed in plan.

The panels of the modular elements are ordinarily made of corrugated paperboard or the like well adapted to the placement thereon of any desired graphics.

DRAWINGS

Figure 1:
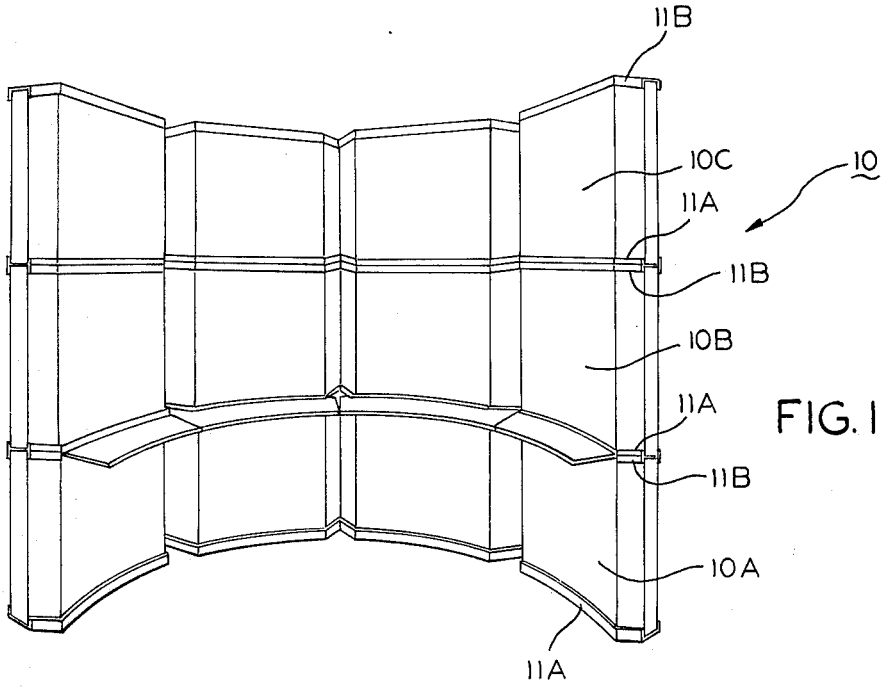
FIG. 1 is an isometric view of erected modules of wall elements constructed in accordance with the present invention.
Figure 2:
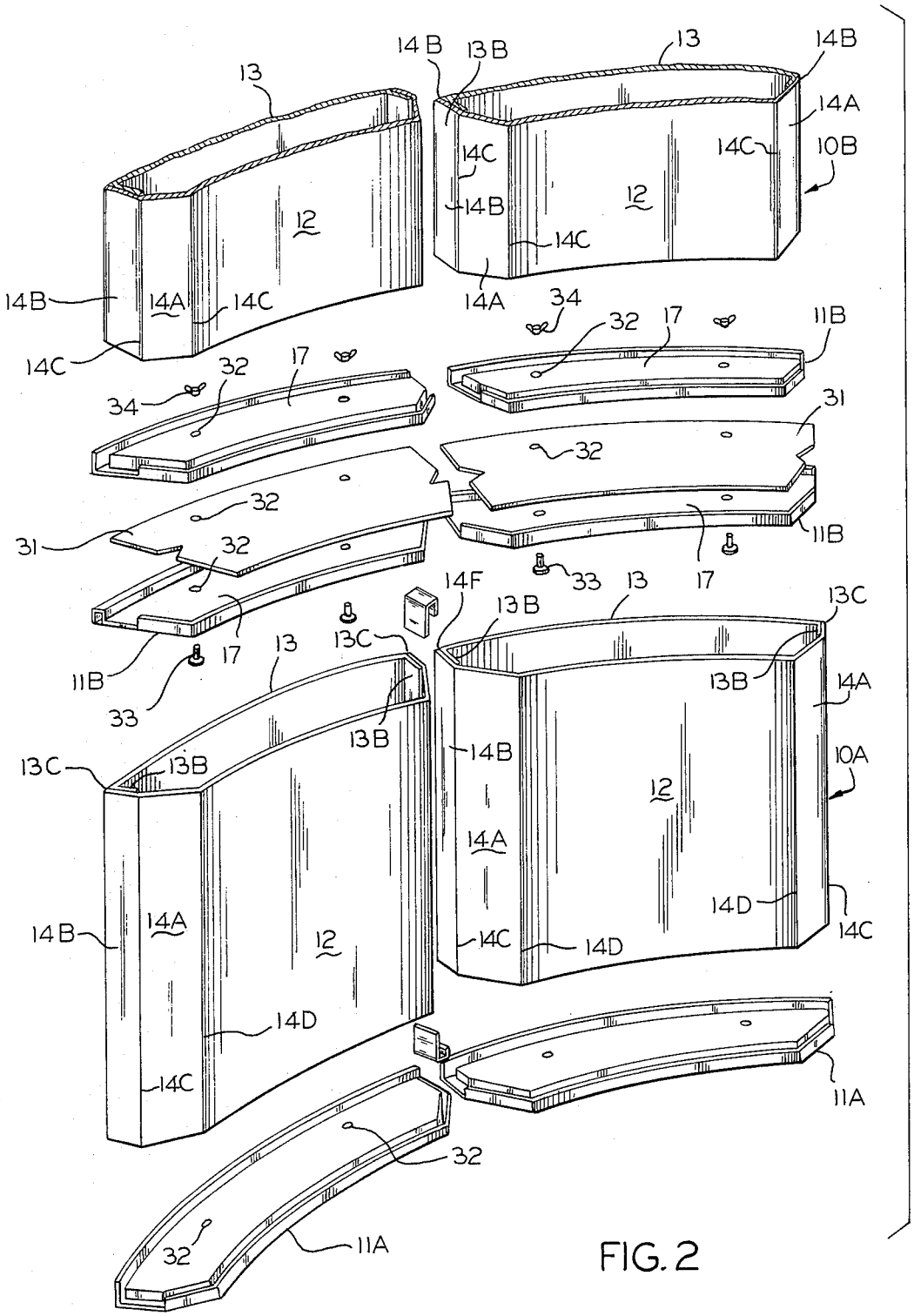
FIG. 2 is an exploded isometric view of a pair of side-by-side modules thereof.
Figure 3:
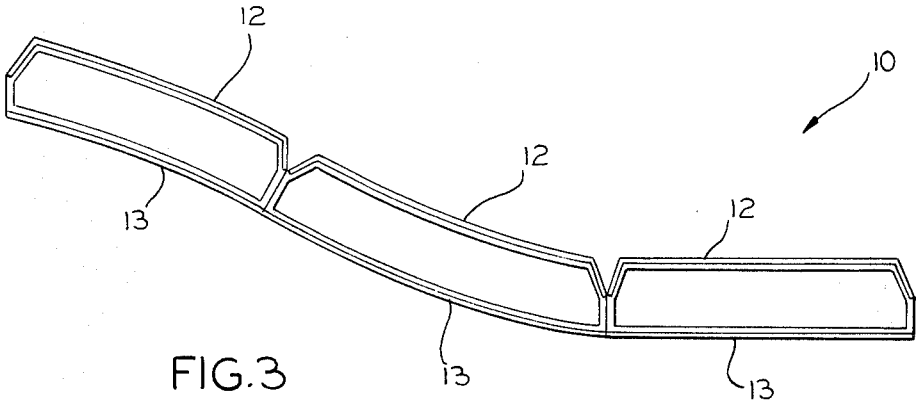
FIG. 3 is a schematic plan view illustrating how the modules may be arranged in serpentine fashion.

Referring now particularly to FIGS. 1 and 2 of the drawings the readily erectable and dismantleable structure according to the present invention is referred generally by the reference numeral 10, and consists of a plurality of stacked structures, one being denoted by reference numeral 10A, and being surmounted by a like structure 10B in turn surmounted by a like structure 10B. As seen in FIG. 1, the structures 10A, 10B and 10C are arranged in a somewhat semi-circular fashion, but as will be explained in detail as this specification proceeds, they may also be erected or arranged in a serpentine fashion as seen in FIG. 3. Also, the structures may be configured in FIG. 5, with flat front and rear surfaces.

Figure 5:
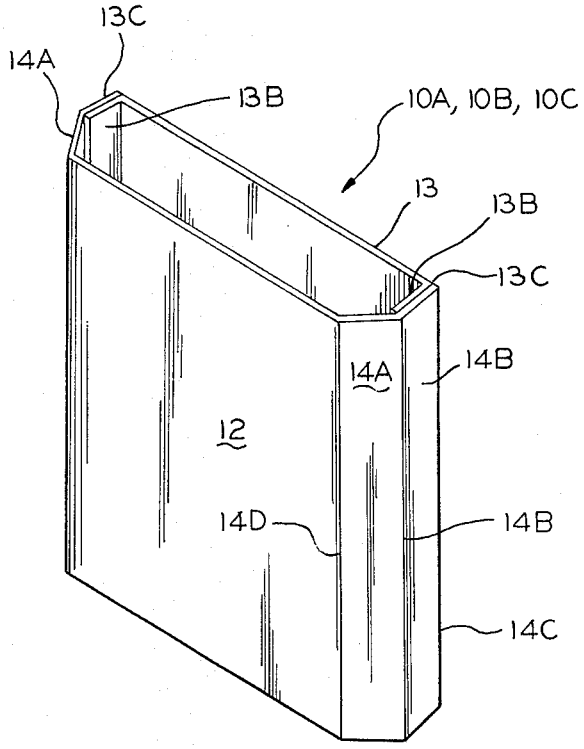
FIG. 5 is an isometric view showing another form of wall element adapted to be confined between upper and lower devices of the type seen in FIG. 4.

In FIG. 2 there is shown a typical wall structure 10A which may have a curved configuration as shown in cross-section, or the essentially rectangular cross-section as seen in FIG. 5, each of such wall structures consisting of upper and lower wall element confining devices 11A and 11B arranged individually to support the wall element 10A, 10B and 10C, as the case may be and to confine such wall element therebetween.

Each of the wall elements 10A is formed from a sheet of light weight fibrous material such as corrugated packaging material, fibre board or the like capable of being folded along score lines therein to provide a front wall 12 and rear wall 13 spaced therefrom. Front wall 12 is provided with end wall portions 14A and 14B, these being connected to each other along fold lines 14C and to front wall along a like fold line 14D. Rear wall 13 is connected to the end wall portions 14B by a flap 13B along a fold line 13C.

Figure 6:
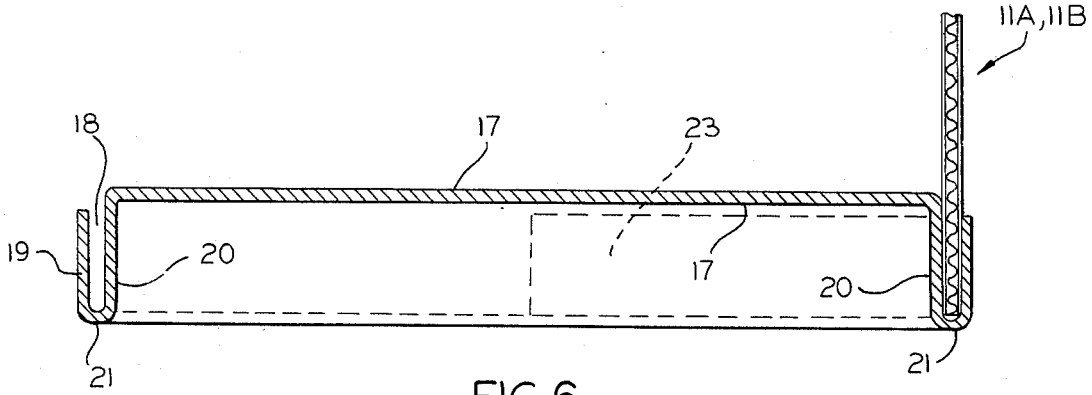
FIG. 6 is a transverse cross section taken through the device seen in FIG. 4 along the line of 6—6 thereof looking in the direction of the arrows.
Figure 4:
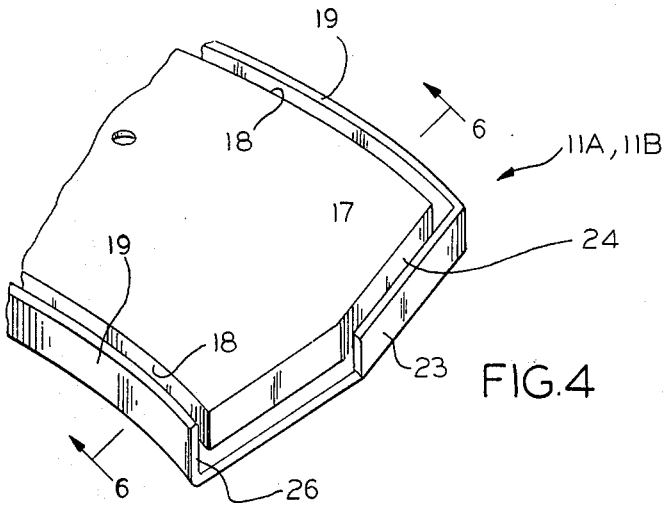
FIG. 4 is a fragmentary isometric view of upper and lower wall element device confining wall elements adapted to be confined therewithin.

Each of the thus far described wall elements 10A, 10B or 10C is adapted to be disposed in proper position by the upper and lower wall element confining devices 11A and 11B. As seen in FIG. 4, each of such devices includes a base member 17 formed at the forward and rear sides thereof integrally with flanges 19 defining therewith grooves 18 for the reception of the upper and lower edges of front wall element 12 and the rear wall element 13. Groove 18 is also defined by a flange 19 spaced from a downstanding flange 20 formed integrally with the base member 17, the two flanges 19 and 20 being continuous with a bight 21 as seen more clearly in FIG. 6. The ends of the base members 17 are likewise formed at the ends thereof with spaced flanges 23 defining a groove 24, and the ends of base members 17 are discontinuous as seen at 26.

Figure 7:
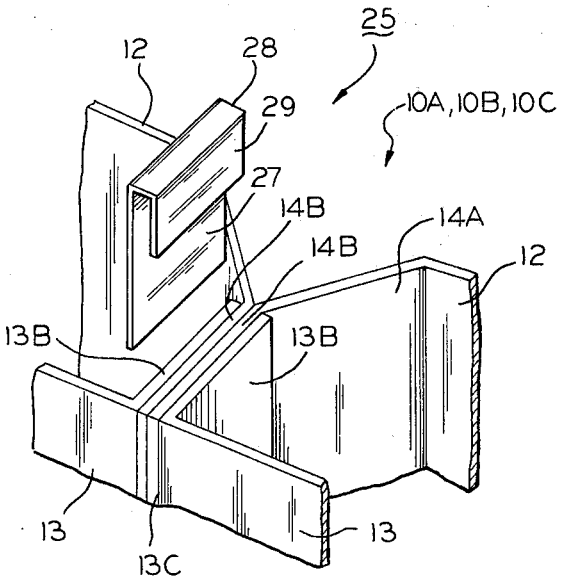
FIG. 7 is an isometric view showing the manner in which upper extremities of the wall elements are held together preparatory of placing one of the devices illustrated in FIG. 4 thereon.

Each of the discontinuous portions 26 in the base members 11A, 11B or 11C is arranged to accommodate the extension 14B of the front wall portions 12 and the extensions 13B of the rear wall portions 13. Such extensions 14B of the front wall portion 12 and the extension 13B of the rear wall portion 13 are adapted to be held together at such discontiguous portions 26 by means of a clip referred to generally by the reference numeral 25 having a downstanding flange 27 adapted to be in confronting relationship with the extension 13B of the rear wall portion 13, see FIG. 7, the downstanding flange 27 being continuous with a saddle 28 overriding and underriding the extensions 13B and 14B of contiguous wall elements as seen in FIG. 7, the saddle number 27 having a downstanding member adapted to be in confronting relationship with the extension 13B of a contiguous wall element as seen more clearly in FIG. 7.

As seen in FIGS. 1 and 2, particularly, devices 11B, which are arranged to surmount lower most wall elements 10A and to undermount superimposed elements 10B are adapted to support shelf member 31 disposed therebetween. In order to secure a superimposed wall element 10B to a lower wall element 10A without the interposition of a shelf element 31, each of the confining devices 11A or 11B is provided with drilled apertures 32 adapted to receive fastening bolts 33 held by nuts 34.

I claim:

1. In a module for erected wall elements for exhibition purposes wherein said wall elements are formed from a sheet of light weight fibrous material capable of being folded along score lines therein and having spaced planar front, rear and end wall portions, the improvement in said module comprising:

a. upper and lower wall element confining devices arranged individually to support said wall elements and to surmount and undermount the same for such confinement;

b. each of said devices having a base with spaced flanges standing therefrom to confine edge portions of the front and rear planar portions of said wall elements;

c. each of said devices having certain spaced flanges at the ends thereof continuous with the first named flanges to receive the returns from said front wall portions for confinement of said return;

d. each of the ends of said devices being provided with a discontinuity in one of the spaced flanges thereof portion elements;

e. each of said discontinuous portions in said devices being constructed and arranged to accommodate extensions from said rear planar portions and portions of said returns in overlapping relation.

2. The module according to claim 1 wherein the edges of said extensions are held together at the discontinuous portions of the spaced flanges of said upper and lower wall element confining devices.

3. The module according to claim 1 wherein said similar spaced flanges are disposed at an angle less than 90° with respect to the spaced flanges for said front wall portions to provide discontinuity in said front wall portions when said devices are arranged in end to end relationship.

* * * * *